US006813890B2

(12) United States Patent
Martling et al.

(10) Patent No.: US 6,813,890 B2
(45) Date of Patent: Nov. 9, 2004

(54) FULLY PREMIXED PILOTLESS SECONDARY FUEL NOZZLE

(75) Inventors: Vincent C. Martling, Boynton Beach, FL (US); Robert J. Kraft, Palm City, FL (US); Brian R. Mack, Palm City, FL (US)

(73) Assignee: Power Systems Mfg. LLC., Jupiter, FL (US)

( * ) Notice: Subject to any disclaimer, the term of this patent is extended or adjusted under 35 U.S.C. 154(b) by 0 days.

(21) Appl. No.: 10/324,949

(22) Filed: Dec. 20, 2002

(65) Prior Publication Data

US 2004/0118119 A1 Jun. 24, 2004

(51) Int. Cl.[7] ..... F23R 3/30
(52) U.S. Cl. ..... 60/737; 60/740
(58) Field of Search ..... 60/734, 737, 739, 60/740, 746, 747

(56) References Cited

U.S. PATENT DOCUMENTS

| | | | | |
|---|---|---|---|---|
| 4,292,801 A | * | 10/1981 | Wilkes et al. | 60/747 |
| 4,982,570 A | | 1/1991 | Waslo et al. | |
| 5,199,265 A | | 4/1993 | Borkowicz | |
| 6,282,904 B1 | | 9/2001 | Kraft et al. | |
| 6,446,439 B1 | | 9/2002 | Kraft et al. | |
| 6,698,207 B1 | * | 3/2004 | Wiebe et al. | 60/737 |
| 2003/0024249 A1 | * | 2/2003 | Akagi et al. | 60/740 |

* cited by examiner

*Primary Examiner*—Louis J. Casaregola
(74) *Attorney, Agent, or Firm*—Brian R. Mack

(57) ABSTRACT

A premix secondary fuel nozzle for use in transferring a flame from a first combustion chamber to a second combustion chamber is disclosed. The secondary fuel nozzle includes multiple fuel circuits, each of which are fully premixed, and neither of which are injected in a manner to directly initiate or support a pilot flame, thereby lowering emissions. Multiple embodiments are disclosed for alternate configurations of a first fuel injector, including an annular manifold and a plurality of radially extending tubes.

18 Claims, 6 Drawing Sheets

FULLY PREMIXED PILOTLESS SECONDARY FUEL NOZZLE

BACKGROUND OF THE INVENTION

1. Field of the Invention

This invention relates generally to a premix fuel nozzle for use in a gas turbine combustor and more specifically to a premix fuel nozzle that does not contain a fuel circuit dedicated to support a pilot flame.

2. Description of Related Art

The U.S. Government has enacted requirements for lowering pollution emissions from gas turbine combustion engines, especially nitrogen oxide (NOx) and carbon monoxide CO. These emissions are of particular concern for land based gas turbine engines that are used to generate electricity since these types of engines usually operate continuously and therefore emit steady amounts of NOx and CO. A variety of measures have been taken to reduce NOx and CO emissions including the use of catalysts, burning cleaner fuels such as natural gas, and improving combustion system efficiency. One of the more significant enhancements to land based gas turbine combustion technology has been the use of premixing fuel and compressed air prior to combustion. An example of this technology is shown in FIG. 1 and discussed further in U.S. Pat. No. 4,292,801. FIG. 1 shows a dual stage dual mode combustor typically used in a gas turbine engine for generating electricity. Combustor 12 has first stage combustion chamber 25 and a second stage combustion chamber 26 interconnected by a throat region 27, as well as a plurality of diffusion type fuel nozzles 29. Depending on the mode of operation, combustion may occur in first stage combustion chamber 25, second stage combustion chamber 26, or both chambers. When combustion occurs in second chamber 26, the fuel injected from nozzles 29 mixes with air in chamber 25 prior to ignition in second chamber 26. As shown in FIG. 1, an identical fuel nozzle 29 is positioned proximate throat region 27 to aid in supporting combustion for second chamber 26. While the overall premixing effect in first chamber 25 serves to reduce NOx and CO emissions from this type combustor, further enhancements have been made to the centermost fuel nozzle since fuel and air from this fuel nozzle undergo minimal mixing prior to combustion.

A combined diffusion and premix fuel nozzle, which is shown in FIG. 2, has been used instead of the diffusion type fuel nozzle shown proximate throat region 27 in FIG. 1. Although an improvement was attained through premix nozzle 31, this nozzle still contained a fuel circuit 32 that contained fuel that did not adequately mix with air prior to combusting and therefore contributed to elevated levels of NOx and CO emissions. As a result, this fuel nozzle was modified such that all fuel that was injected into a combustor was premixed with compressed air prior to combustion to create a more homogeneous fuel/air mixture that would burn more completely and thereby result in lower emissions. This improved fully premixed fuel nozzle is shown in FIG. 3 and discussed further in U.S. Pat. No. 6,446,439. Fuel nozzle 50 contains a generally annular premix nozzle 51 having a plurality of injector holes 52 and a premix pilot nozzle 53 with a plurality of feed holes 54. In this pilot circuit embodiment, fuel enters a premix passage 55 from premix pilot nozzle 53 and mixes with air from air flow channels 56 to form a premixture. Fuel nozzle 50 is typically utilized along the centerline of a combustor similar to that shown in FIG. 1 and aids combustion in second chamber 26. Although the fully premixed fuel nozzle disclosed in FIG. 3 provides a more homogeneous fuel/air mixture prior to combustion than prior art fuel nozzles, disadvantages to the fully premixed fuel nozzle have been discovered, specifically relating to premix pilot nozzle 53. More specifically, in order to maintain emissions levels in acceptable ranges, premix pilot feed holes 54 had to be adjusted depending on the engine type, mass flow, and operating conditions. This required tedious modifications to each nozzle either during manufacturing or during assembly and flow testing, prior to installation on the engine.

In order to simplify the fuel nozzle structure and further improve emissions, it is desirable to have a fuel nozzle that supports combustion in a second combustion chamber 26 without having a pilot circuit. Elimination of a pilot circuit, whether diffusion or premix, will further reduce emissions since the pilot circuit is always in operation whether or not it was actually needed to support combustion. Furthermore, eliminating the pilot circuit will simplify fuel nozzle design and manufacturing. The major concern with eliminating the pilot circuit is combustion stability in the second combustion chamber given the reduced amount of dedicated fuel flow to the secondary fuel nozzle. Experimental testing was conducted on a gas turbine combustor having first and second combustion chambers by blocking the premix pilot nozzle 53 of fuel nozzle 50 in accordance with FIG. 3. The combustor was run through its entire range of operating conditions and positive results were obtained for maintaining a stable flame in the second combustion chamber. Changes in combustion dynamics or pressure fluctuations associated with the elimination of the pilot fuel circuit were found to be minimal and insignificant for typical operating conditions.

SUMMARY AND OBJECTS OF THE INVENTION

An improved fully premixed secondary fuel nozzle for use in a gas turbine combustor having multiple combustion chambers, in which the products of premixed secondary fuel nozzle are injected into the second combustion chamber, is disclosed. The improvement includes the elimination of the pilot fuel circuit, which previously served to support ignition and combustion in the second combustion chamber. The improved premix secondary fuel nozzle includes a first injector extending radially outward from the fuel nozzle body for injecting a fuel to mix with compressed air prior to combustion, a second injector located at the tip region of the fuel nozzle for injecting an additional fluid, either fuel or air, depending on mode of operation, and an air cooled tip having a swirler. In the preferred embodiment, the first injector is an annular manifold extending radially outward from the fuel nozzle by a plurality of support members and contains a plurality of first injector holes. Also in the preferred embodiment, the second injector is in fluid communication with a plurality of transfer tubes that transfer a fluid to the second injector from around the region of the fuel nozzle that contains the cooling air. In an alternate embodiment of the present invention, the first injector comprises a plurality of radially extending tubes and the second injector is in fluid communication with a generally annular passage that transfers a fluid to the second injector from upstream of the first injector.

It is an object of the present invention to provide an improved premix secondary fuel nozzle for use in a gas turbine combustor having a plurality of combustion chambers that does not contain a fuel circuit dedicated to the initiation and support of a pilot flame.

It is a further object of the present invention to provide a gas turbine combustor having stable combustion while producing lower NOx and CO emissions.

In accordance with these and other objects, which will become apparent hereinafter, the instant invention will now be described with particular reference to the accompanying drawings.

DETAILED DESCRIPTION OF THE PREFERRED EMBODIMENT

Figure 1:
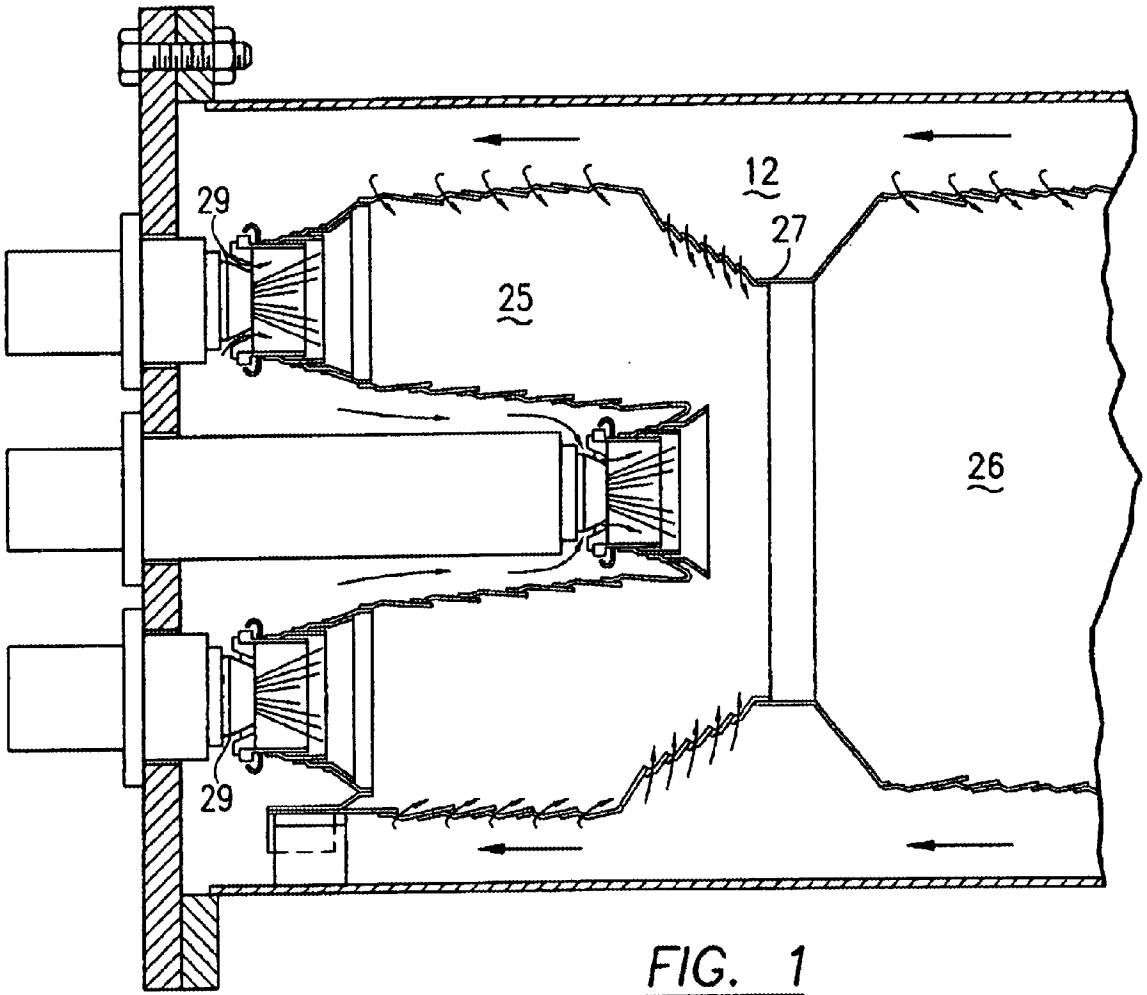
FIG. 1 PRIOR ART
FIG. 1 is a partial cross section view of a gas turbine combustor of the prior art having first and second combustion chambers.
Figure 2:
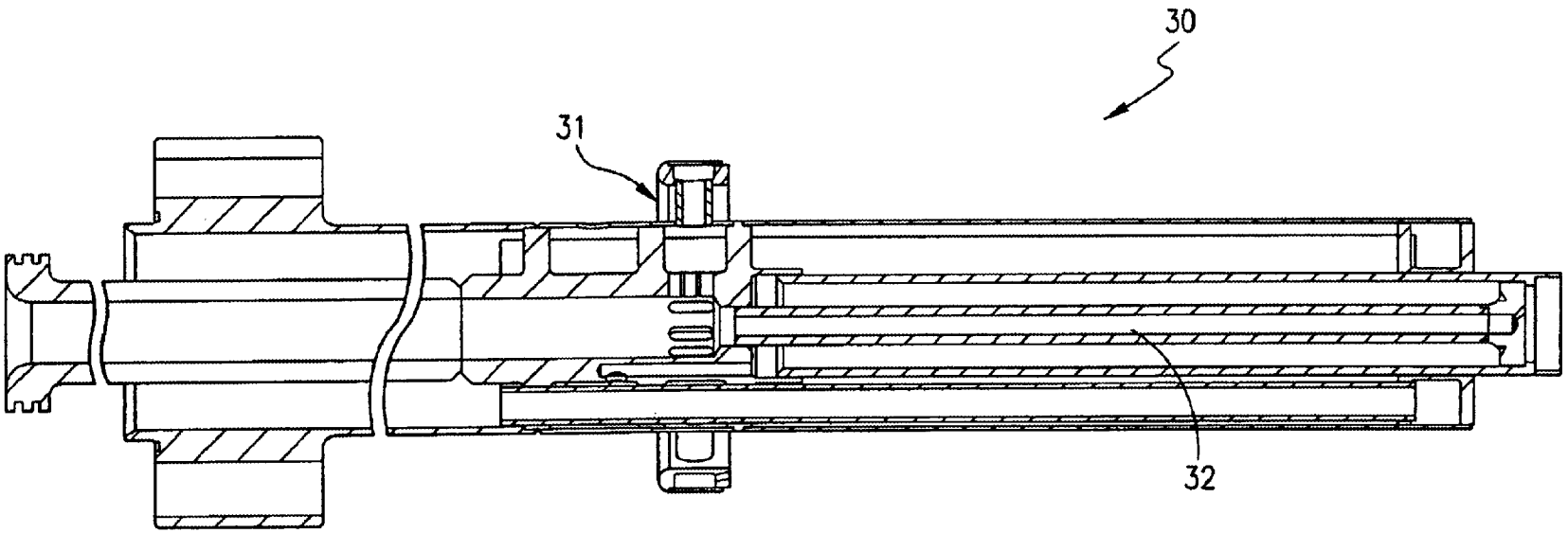
FIG. 2 PRIOR ART
FIG. 2 is a partial cross section view of a secondary fuel nozzle of the prior art.
Figure 3:
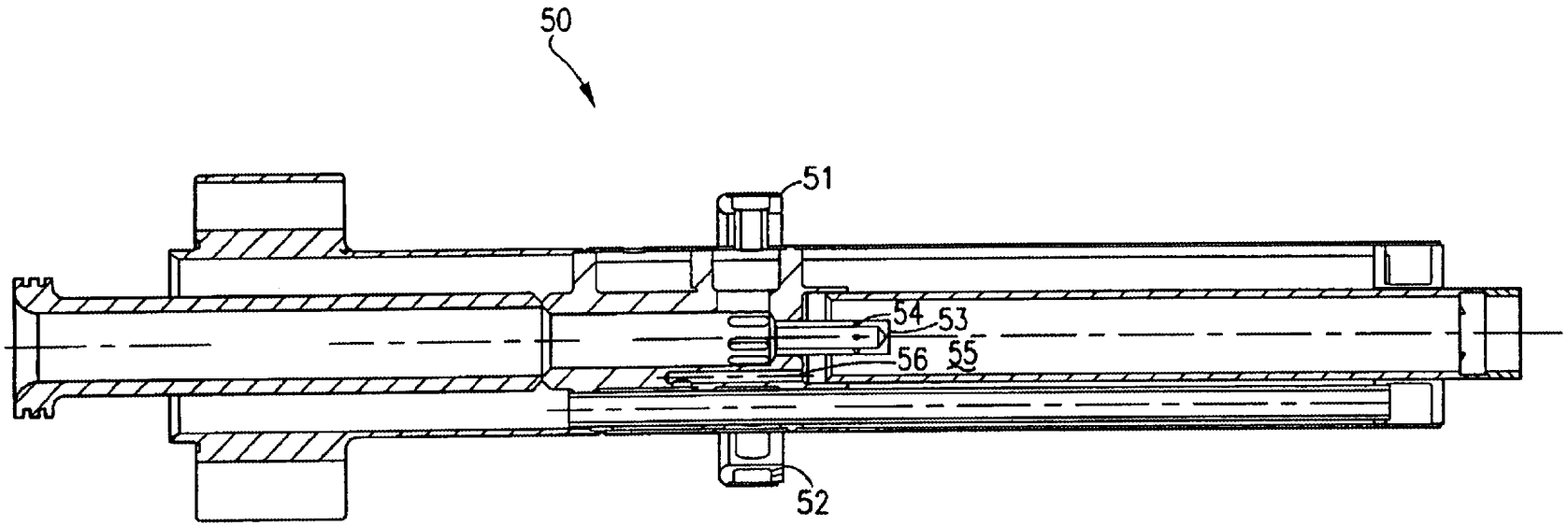
FIG. 3 PRIOR ART
FIG. 3 is a cross section view of a premix secondary fuel nozzle of the prior art.
Figure 4:
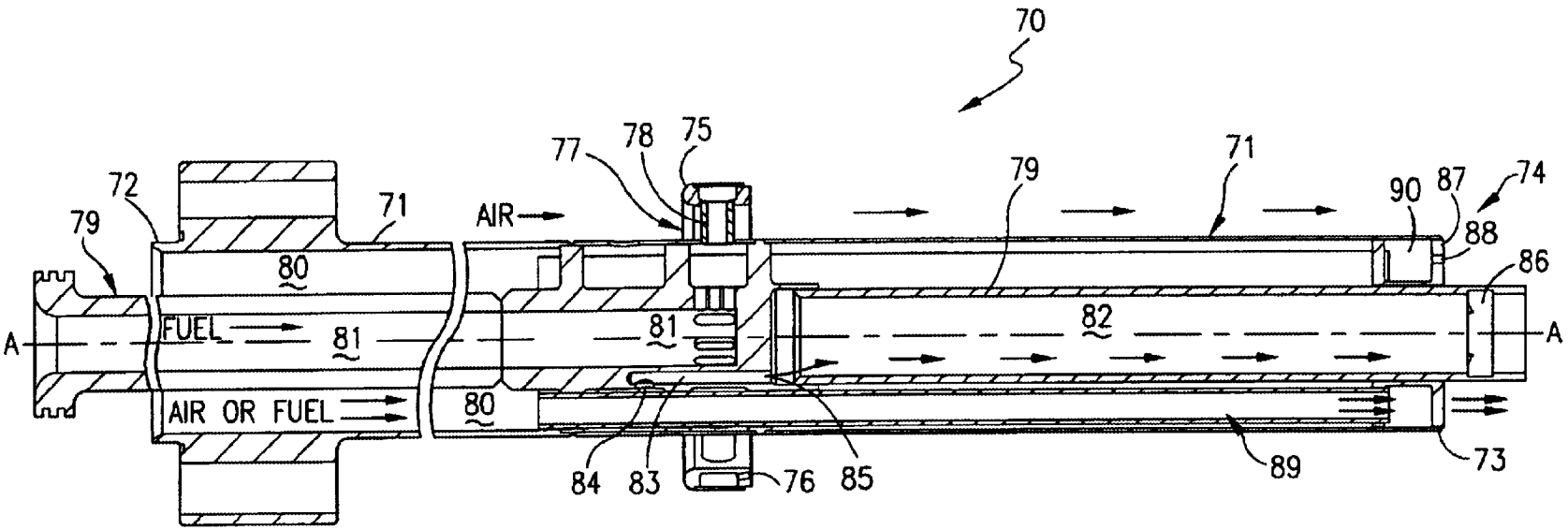
FIG. 4 is a partial cross section view of a premix secondary fuel nozzle in accordance with the preferred embodiment of the present invention.
Figure 5:
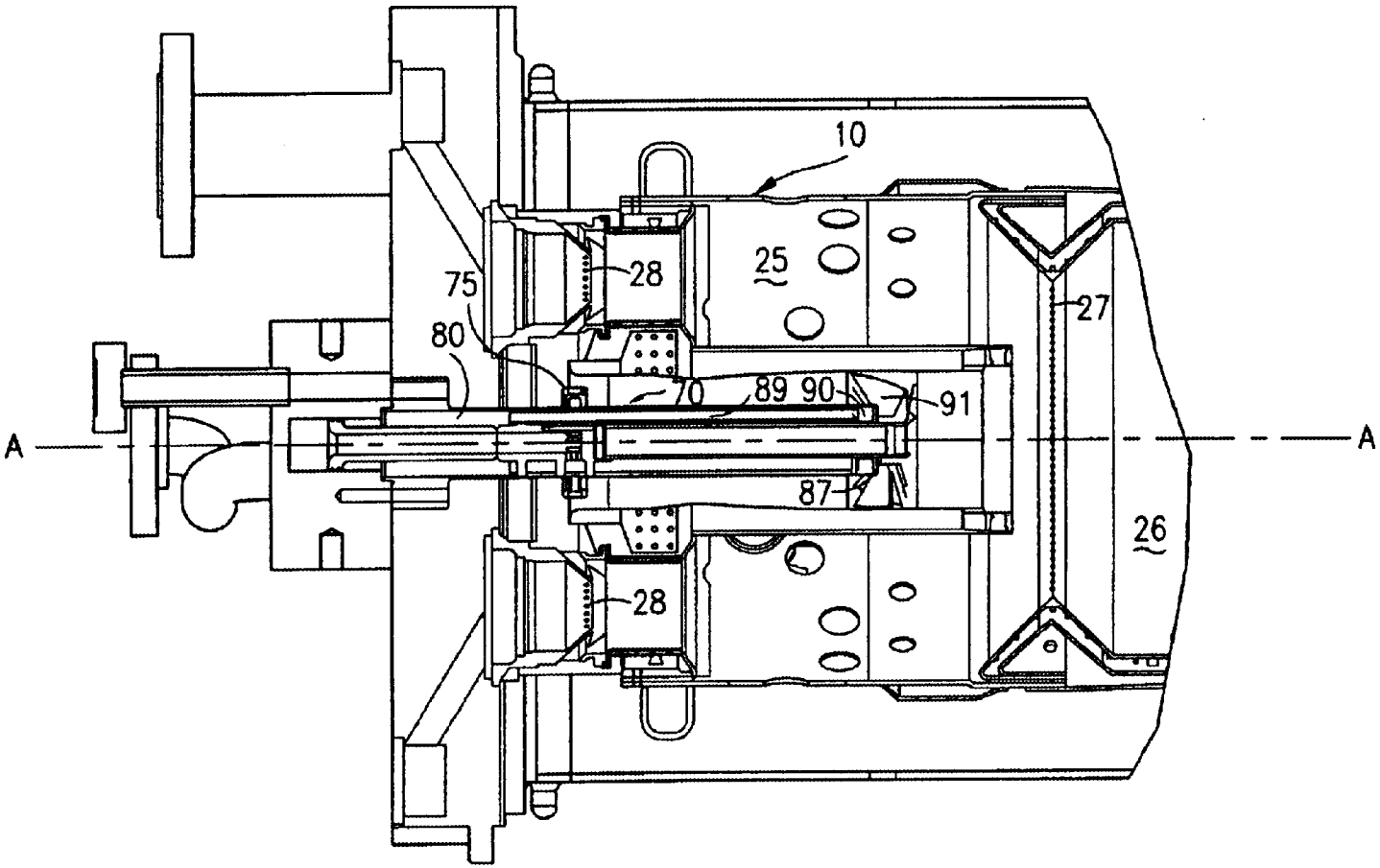
FIG. 5 is a partial cross section of a gas turbine combustor utilizing the preferred embodiment of the present invention.
Figure 6:
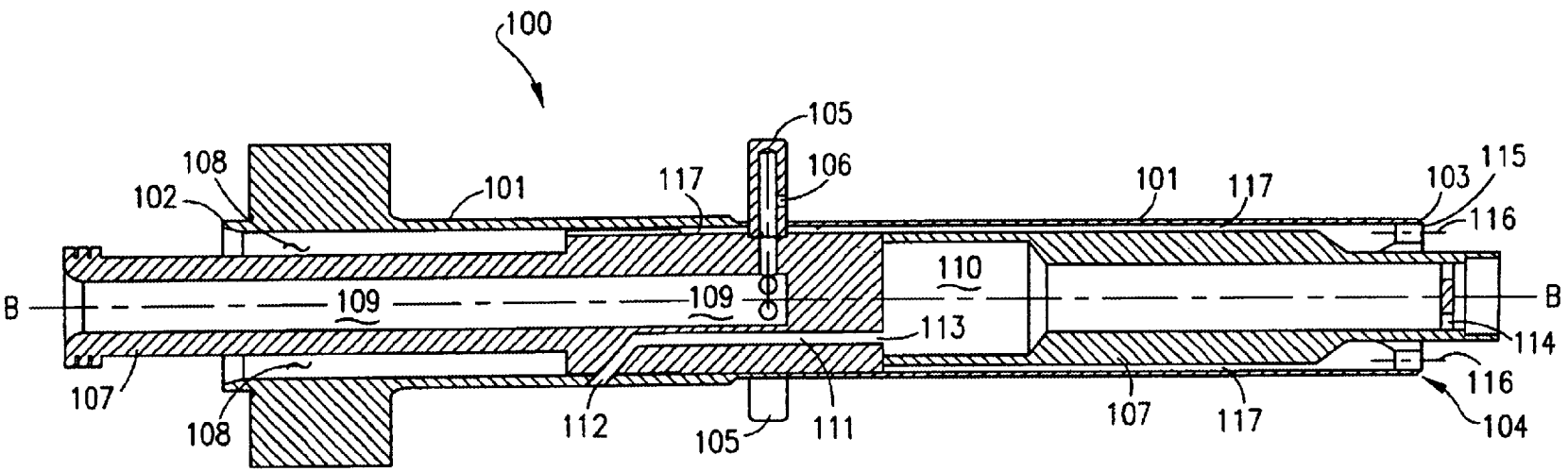
FIG. 6 is a cross section view of a premix secondary fuel nozzle in accordance with an alternate embodiment of the present invention.

The present invention will now be described in detail and is shown in FIGS. 4 through 6. Referring now to FIG. 4, which is the preferred embodiment, a premixed secondary fuel nozzle 70 is shown in cross section. Secondary fuel nozzle 70 is utilized primarily to support combustion in a second combustion chamber of a gas turbine combustor having a plurality of combustion chambers. Secondary fuel nozzle 70 is comprised of an elongated tube 71 having a first end 72, an opposing second end 73, a centerline A—A defined therethrough, and a tip region 74 proximate second end 73. Fuel nozzle 70 also contains at least one first injector 75, which extends radially away from and is fixed to elongated tube 71. First injector 75 contains at least one first injector hole 76 for injecting a fuel into a combustor such that air surrounding fuel nozzle 70 mixes with the fuel to form a premixture. In the preferred embodiment, first injector 75 comprises an annular manifold 77 circumferentially disposed about elongated tube 71 and affixed to a plurality of support members 78 which are affixed to elongated tube 71. In this embodiment, at least one first injector hole 76 comprises a plurality of holes situated about the periphery of annular manifold 77 and are oriented to inject fuel in a downstream direction with at least one first injector hole being circumferentially offset from support members 78. Furthermore, in order to provide the appropriate fuel distribution from first injector holes 76, at least one of first injectors holes 76 is angled relative to the downstream direction.

Secondary fuel nozzle 70 also includes a central core 79 coaxial with centerline A—A and located radially within elongated tube 71 thereby forming a first passage 80 between central core 79 and elongated tube 71. Central core 79 extends from proximate first opposing end 72 to proximate second opposing end 73 and contains a second passage 81, which extends from proximate first opposing end 72 to proximate first injector 75 and is in fluid communication with first injector 75. Located axially downstream from second passage 81, contained within central core 79, and extending to proximate second opposing end 73, is a third passage 82, which along with second passage 81 is coaxial with centerline A—A. Central core 79 also contains a plurality of air flow channels 83, typically seven, which have an air flow inlet region 84, an air flow exit region 85, and are in fluid communication with third passage 82. Due to the geometry of air flow channels 83 and positioning of air flow inlet region 84, first passage 80 extends from proximate first opposing end 72 to a point upstream of air flow inlet region 84.

Positioned proximate nozzle tip region 74 and fixed within third passage 82 is a swirler 86 that is used to impart a swirl to air from third passage 82 for cooling nozzle tip region 74. Also located proximate nozzle tip region 74 at second opposing end 73 is a second injector 87 which contains a plurality of second injector holes 88 for injecting a fluid medium into a combustor. The fluid medium injected through second injector initiates in first passage 80 and is transferred to second injector 87, in the preferred embodiment, by means of a plurality of transfer tubes 89, typically seven, which have opposing ends and surround third passage 82. Transfer tubes 89 extend from upstream of first injector 75 to an annular plenum 90, which is adjacent second injector 87. Depending on the mode of operation, first passage 80, transfer tubes 89, and annular plenum 90, may contain either fuel or air. For a combustor having a first combustion chamber and a second combustion chamber, as shown in FIG. 5, fuel is supplied to first passage 80, transfer tubes 89, and annular plenum 90 and injected through second injector 87 in an effort to transfer the flame from a first combustion chamber to a second combustion chamber. In this type of combustion system 10 there is a first combustion chamber or primary combustion chamber 25 and at least one primary fuel nozzle 28 delivering fuel to primary combustion chamber 25 where initial combustion occurs. Adjacent to and downstream of primary combustion chamber 25 is a secondary combustion chamber 26 with the combustion chambers separated by a venturi 27. Primary fuel nozzles 28 surround secondary fuel nozzle 70, which injects fuel towards secondary combustion chamber 26 to support combustion downstream of venturi 27. From FIG. 5 it can be seen that all fuel from premix secondary fuel nozzle 70 is injected such that it must premix with the surrounding air and pass through cap swirler 91 prior to entering secondary combustion chamber 26. Prior art designs allowed fuel from secondary fuel nozzles to pass directly into secondary combustion chamber 26 without passing through cap swirler 91, thereby directly initiating and supporting a pilot flame, which is typically a source of high emissions. Referring now to FIG. 6, an alternate embodiment of the present invention is shown in cross section. The alternate embodiment is similar to the preferred embodiment in structure and identical to the preferred embodiment in purpose and function. A premix secondary fuel nozzle 100 contains an elongated tube 101 having a first end 102 and an opposing second end 103, a centerline B—B defined therethrough, and a tip region 104 proximate second end 103. Extending radially away and fixed to elongated tube 101 is at least one first injector 105 having at least one first injector hole 106 for injecting a fuel into a combustor so that the surrounding air mixes with the fuel to form a premixture. In the alternate embodiment, at least one first injector comprises a plurality of radially extending tubes, with each of the tubes having at least one first injector hole 106 that injects fuel in the downstream direction. Fuel injection may be directly downstream or first injector holes maybe oriented at an angle relative to the downstream direction to improve fuel distribution in the surrounding air.

Alternate premix secondary fuel nozzle 100 also contains a central core 107 coaxial with centerline B—B and located radially within elongated tube 101 to thereby form a first passage 108 between central core 107 and elongated tube 101. Central core 107 extends from proximate first opposing end 102 to second opposing end 103 and contains a second passage 109 that extends from proximate first opposing end 102 to proximate first injector 105 and is in fluid communication with first injector 105. Central core 107 also contains a third passage 110 that extends from downstream of first injector 105 to proximate second opposing end 103 such that third passage 110 and second passage 109 are both coaxial with centerline B—B. Another feature of central core 107 is the plurality of air flow channels 111 that are in fluid communication with third passage 110 and each having an air flow inlet region 112 and an air flow exit region 1113. Air passes from air flow channels 111, through third passage 110, and flows through a swirler 114, which is fixed within third passage 110 for imparting a swirl to the air, in order to more effectively cool tip region 104.

A second injector 115 is positioned at second end 103, proximate nozzle tip region 104, and contains a plurality of second injector holes 116 for injecting a fluid medium into a combustor. The fluid medium injected through second injector 115 initiates in first passage 108 and flows around central core 107 through a generally annular passageway 117 while being transferred to second injector. Depending on the mode of operation, first passage 108 and annular passage 117 may contain either fuel or air. For a combustor having a first combustion chamber and a second combustion chamber, and as shown in FIG. 5, fuel is supplied to first passage 108, annular passage 117, and injected through second injector 115 in an effort to transfer the flame from a first combustion chamber 25 to a second combustion chamber 26. As with the preferred embodiment, all fuel for combustion from the alternate embodiment secondary fuel nozzle is injected radially outward of and upstream of swirler 114 such that the fuel is injected in a manner that must premix with the surrounding air and pass through cap swirler 91 prior to entering secondary combustion chamber 26.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. An improved premix secondary fuel nozzle for use in a gas turbine combustor comprising:

an elongated tube having a first and second opposing ends having a centerline defined therethrough and a tip region proximate said second end;

at least one first injector extending radially away from and fixed to said elongated tube and containing at least one first injector hole for injecting a fuel into said combustor such that air surrounding said fuel nozzle mixes with said fuel to form a premixture;

a central core coaxial with said centerline and located radially within said elongated tube thereby forming a first passage between said central core and said elongated tube, said central core extending from proximate said first opposing end to proximate said second opposing end, said central core containing a second passage extending from proximate said first opposing end to proximate said first injector for supplying fuel to said first injector, said central core also containing a third passage extending from downstream of said first injector to proximate said second opposing end, each of said second and third passages coaxial with said centerline, and said central core further containing a plurality of air flow channels in fluid communication with said third passage, said air flow channels having an air flow inlet region and air flow exit region, and said first passage extending from proximate said first opposing end to upstream of said air flow inlet region of said air flow channels;

a swirler fixed within said third passage for imparting a swirl to said air to cool said tip region of said fuel nozzle;

a second injector containing a plurality of second injector holes located proximate said second opposing end of said elongated tube for injecting a fluid medium into said combustor;

means for transferring said fluid medium from said first passage to said second injector;

wherein all fuel is injected radially outward of and upstream of said swirler so as to not directly initiate a pilot flame.

2. The improved premix secondary fuel nozzle of claim 1 wherein said first injector comprises an annular manifold circumferentially disposed about said elongated tube and affixed to a plurality of support members, said support members affixed to said elongated tube such that said annular manifold is in fluid communication with said second passage, said annular manifold having a plurality of first injector holes situated about its periphery and oriented to inject said fuel in a downstream direction, at least one of said first injector holes being circumferentially offset from said support members.

3. The improved premix secondary fuel nozzle of claim 2 wherein at least one of said first injector holes of said annular manifold is angled relative to the downstream direction.

4. The improved premix secondary fuel nozzle of claim 1 wherein said means for transferring said medium includes a plurality of transfer tubes having opposing ends, said transfer tubes surrounding said third passage and extending from upstream of said first injector to an annular plenum proximate said second injector.

5. The improved premix secondary fuel nozzle of claim 4 wherein said fluid medium can be either fuel or air, depending on combustor mode of operation.

6. The improved premix secondary fuel nozzle of claim 4 wherein seven of said transfer tubes surrounds seven of said air flow channels.

7. The improved premix secondary fuel nozzle of claim 1 wherein said first injector comprises a plurality of radially extending tubes, each of said tubes having at least one first hole, said hole injecting said fuel in the downstream direction, said plurality of radially extending tubes are in fluid communication with said second passage.

8. The improved premix secondary fuel nozzle of claim 7 wherein at least one of said first injector holes is angled in the circumferential direction.

9. The improved premix secondary fuel nozzle of claim 1 wherein said means for transferring said fluid medium comprises a generally annular passageway extending from upstream of said first injector to said second injector.

10. An improved dual stage, dual mode gas turbine combustor comprising:

a primary combustion chamber;

at least one primary fuel nozzle to deliver fuel to said primary combustion chamber;

a secondary combustion chamber adjacent to and downstream of said primary combustion chamber wherein said primary and secondary combustion chambers are separated by a venturi; and a secondary fuel nozzle positioned to inject fuel towards said secondary combustion chamber and surrounded by a plurality of said primary fuel nozzles wherein said secondary fuel nozzle comprises:

an elongated tube having a first and second opposing ends having a centerline defined therethrough and a tip region proximate said second end;

at least one first injector extending radially away from and fixed to said elongated tube and containing at least one first injector hole for injecting a fuel into said combustor such that air surrounding said fuel nozzle mixes with said fuel to form a premixture;

a central core coaxial with said centerline and located radially within said elongated tube thereby forming a first passage between said central core and said elongated tube, said central core extending from proximate said first opposing end to proximate said second opposing end, said central core containing a second passage extending from proximate said first opposing end to proximate said first injector for supplying fuel to said first injector, said central core also containing a third passage extending from downstream of said first injector to proximate said second opposing end, each of said second and third passages coaxial with said centerline, and said central core further containing a plurality of air flow channels in fluid communication with said third passage, said air flow channels having an air flow inlet region and air flow exit region, and said first passage extending from proximate said first opposing end to upstream of said air flow inlet region of said air flow channels;

a swirler fixed within said third passage for imparting a swirl to said air to cool said tip region of said fuel nozzle;

a second injector containing a plurality of second injector holes located proximate said second opposing end of said elongated tube for injecting a fluid medium into said combustor;

means for transferring said fluid medium from said first passage to said second injector;

wherein all fuel is injected radially outward of and upstream of said swirler so as to not directly initiate a pilot flame.

11. The improved gas turbine combustor of claim 10 wherein said first injector comprises an annular manifold circumferentially disposed about said elongated tube and affixed to a plurality of support members, said support members affixed to said elongated tube such that said annular manifold is in fluid communication with said second passage, said annular manifold having a plurality of first injector holes situated about its periphery and oriented to inject said fuel in a downstream direction, at least one of said first injector holes being circumferentially offset from said support members.

12. The improved gas turbine combustor of claim 11 wherein at least one of said first injector holes of said annular manifold is angled relative to the downstream direction.

13. The improved gas turbine combustor of claim 10 wherein said means for transferring said medium includes a plurality of transfer tubes having opposing ends, said transfer tubes surrounding said third passage and extending from upstream of said first injector to an annular plenum proximate said second injector.

14. The improved gas turbine combustor of claim 13 wherein said fluid medium can be either fuel or air, depending on combustor mode of operation.

15. The improved gas turbine combustor of claim 13 wherein seven of said transfer tubes surrounds seven of said air flow channels.

16. The improved gas turbine combustor of claim 10 wherein said first injector comprises a plurality of radially extending tubes, each of said tubes having at least one first hole, said hole injecting said fuel in the downstream direction, said plurality of radially extending tubes are in fluid communication with said second passage.

17. The improved premix secondary fuel nozzle of claim 16 wherein at least one of said first injector holes is angled in the circumferential direction.

18. The improved premix secondary fuel nozzle of claim 10 wherein said means for transferring said fluid medium comprises a generally annular passageway extending from upstream of said first injector to said second injector.

* * * * *